US006951328B1

(12) United States Patent
Drapeau et al.

(10) Patent No.: US 6,951,328 B1
(45) Date of Patent: Oct. 4, 2005

(54) ADJUSTABLE GARBAGE CAN HOLDER

(76) Inventors: Andre Drapeau, 7471 de Gaspe, Montreal, Quebec (CA) H2R 2A3; Claude Drapeau, 7471 de Gaspé, Montreal, Quebec (CA) H2R-2A3

( * ) Notice: Subject to any disclaimer, the term of this patent is extended or adjusted under 35 U.S.C. 154(b) by 0 days.

(21) Appl. No.: 10/884,264

(22) Filed: Jul. 6, 2004

(51) Int. Cl.[7] ..... A47F 7/00
(52) U.S. Cl. ..... 248/315; 211/85.19; 248/907
(58) Field of Search ..... 248/315, 314, 248/146, 154, 99, 97, 907; 211/85.18, 85.19

(56) References Cited

U.S. PATENT DOCUMENTS

| | | | | |
|---|---|---|---|---|
| 1,124,020 A | | 1/1915 | Hendrick | |
| 2,546,797 A | | 3/1951 | Swisher et al. | |
| 3,141,644 A | * | 7/1964 | Baird | 248/146 |
| 3,173,547 A | * | 3/1965 | Allisandratos | 211/85.19 |
| 3,814,367 A | | 6/1974 | Rasmussen | |
| 3,892,315 A | | 7/1975 | Johnson | |
| 3,990,654 A | | 11/1976 | Michael | |
| 4,606,523 A | | 8/1986 | Statz et al. | |
| 4,741,494 A | * | 5/1988 | Voornas | 248/154 |
| D309,848 S | | 8/1990 | Sokolski et al. | |
| 5,607,133 A | * | 3/1997 | Markham et al. | 248/313 |

* cited by examiner

*Primary Examiner*—Ramon O Ramirez

(57) ABSTRACT

An adjustable garbage can holder that conserves space by mounting to a deck rail includes integral rails sized and positioned for receiving a waste basket therein. Select rails are spaced and extend vertically along the body while other rails have substantially annular shapes spaced along top and bottoms portions of the body for defining a diameter thereof. One of the select rails has a slot formed therein and is positionable adjacent to a support surface. The other rails have end portions securable to each other for selectively adjusting the diameter of the body. The body includes a flange portion that is engageable with the support surface for cooperating therewith to maintain the body at a substantially stable position. The apparatus further includes brackets for attaching the body to the support surface.

15 Claims, 4 Drawing Sheets

ADJUSTABLE GARBAGE CAN HOLDER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a garbage can holder and, more particularly, to an adjustable garbage can holder that is removably mountable to a vertically oriented support surface.

2. Prior Art

The use of garbage cans is well known and documented in the prior art. Garbage cans serve the function of retaining waste materials before their final disposal or collection by the appropriate agency. This effectively prevents the smell of waste from infiltrating residencies and other areas, such as restaurants and office buildings, causing discomfort to the individuals in the presence of the garbage can.

In certain locations, however, the placement of a garbage can could present a problem. The can might take up much needed space, such as on a wooden deck attached to a house. The people would like to maximize the amount of space they have for grilling and entertaining guests, but these events usually result in the accumulation of waste.

Means for garbage can holders are known in the prior art, but these tend to be limited in their function by only being able to accept a garbage can of one particular size. Some are also heavy and cumbersome to move around incase relocation of the garbage can is necessary.

Accordingly, a need remains for an adjustable garbage can holder that is easy to assemble and attach to the side of a fence or deck, and is also easily adjustable to various sized garbage cans. Such a holder will advantageously provide improved deck and patio appearances, while conserving space at the same time.

BRIEF SUMMARY OF THE INVENTION

In view of the foregoing background, it is therefore an object of the present invention to provide an apparatus for an adjustable garbage can holder. These and other objects, features, and advantages of the invention are provided by an adjustable garbage can holder that conveniently conserves space by mounting to a deck rail.

The holder includes a plurality of integral rails preferably formed from spring steel. Such rails are sized and positioned for defining a substantially cylindrical body that has a centrally disposed longitudinal axis for advantageously receiving a waste basket therein. Select ones of the plurality of rails are spaced apart and extend vertically along front and rear portions of the body. Such rails become disposed substantially parallel to the axis and are provided with traversing lower portions. One of such rails has a slot formed generally medially therein and is positionable adjacent a support surface.

Other ones of the plurality of rails have substantially annular shapes spaced along top and bottoms portions of the body for defining a diameter thereof. The opposed end portions of such rails are preferably provided with a plurality of apertures that are respectively alignable for conveniently adjusting a diameter of the body. Advantageously, such rails have opposed end portions removably securable to each other for selectively adjusting the diameter of the body.

The select rails may further have diametrically opposed upper portions, wherein one of the opposed end portions of the other rails are integral with the select rails respectively and another opposed end portion of the other rails is positionable to the exterior of the select rails respectively.

Such a body further includes a flange portion integral with one of the other rails and extends rearwardly therefrom. The flange portion is engageable with the support surface and cooperates therewith to maintain the body at a substantially stable position.

The present invention further includes a plurality of spaced brackets for attaching the body to the support surface. One of the plurality of brackets has a centrally disposed longitudinal axis extending substantially orthogonal to the axis of the body. Such a bracket has a slot extending along the axis thereof and is positionable along an opposite face of the support surface so that a fastening member can be passed from the body rearwardly through the slot for attaching the lower body portion to the support surface.

Another one of the brackets has integral top and side portions disposed substantially orthogonal to each other wherein the top portion is slidably engageable with the flange portion for adjustably fastening the upper body portion to the support surface.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
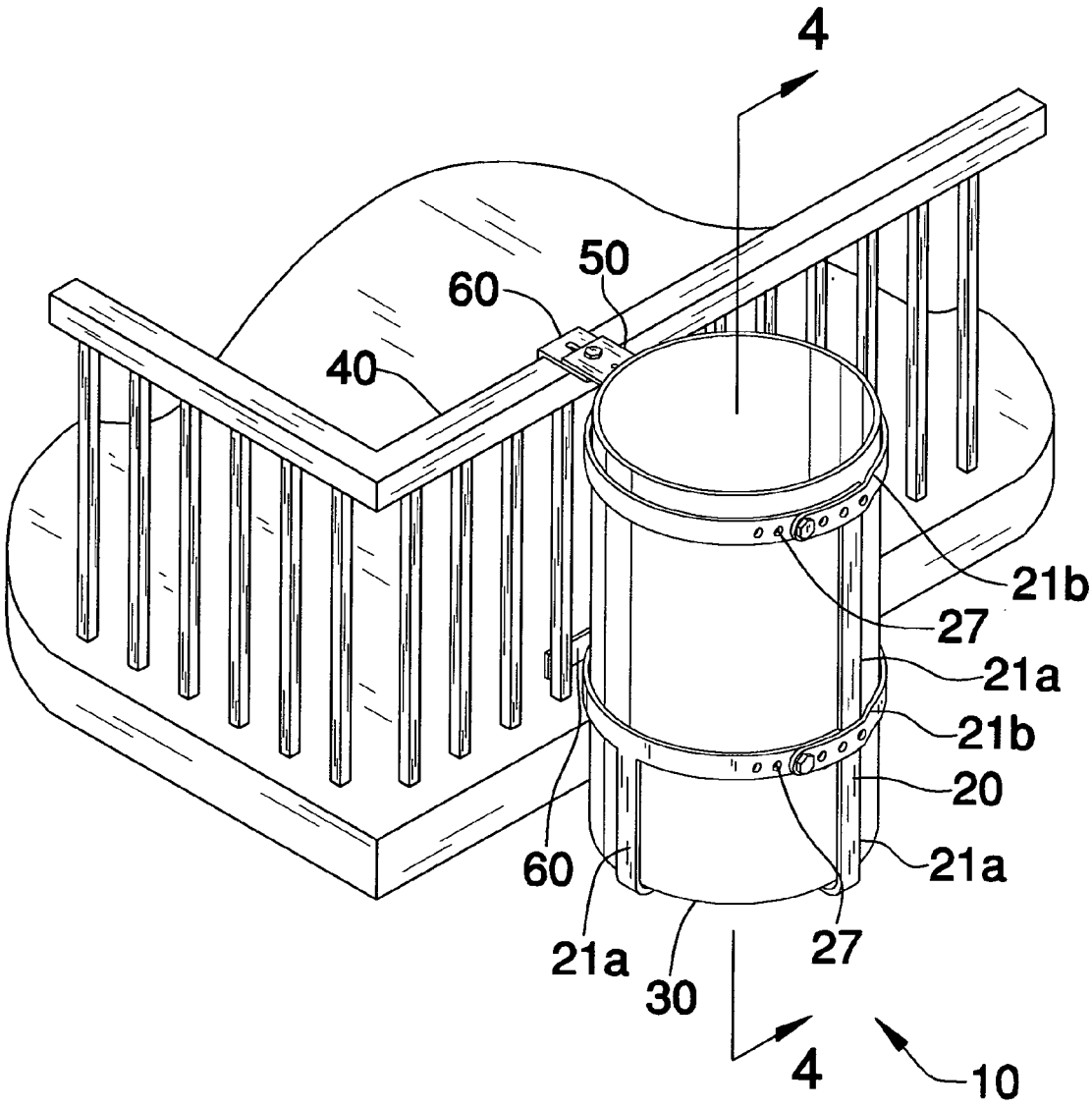
FIG. 1 is a perspective view showing an adjustable garbage can holder secured to a support surface, in accordance with the present invention.
Figure 2:
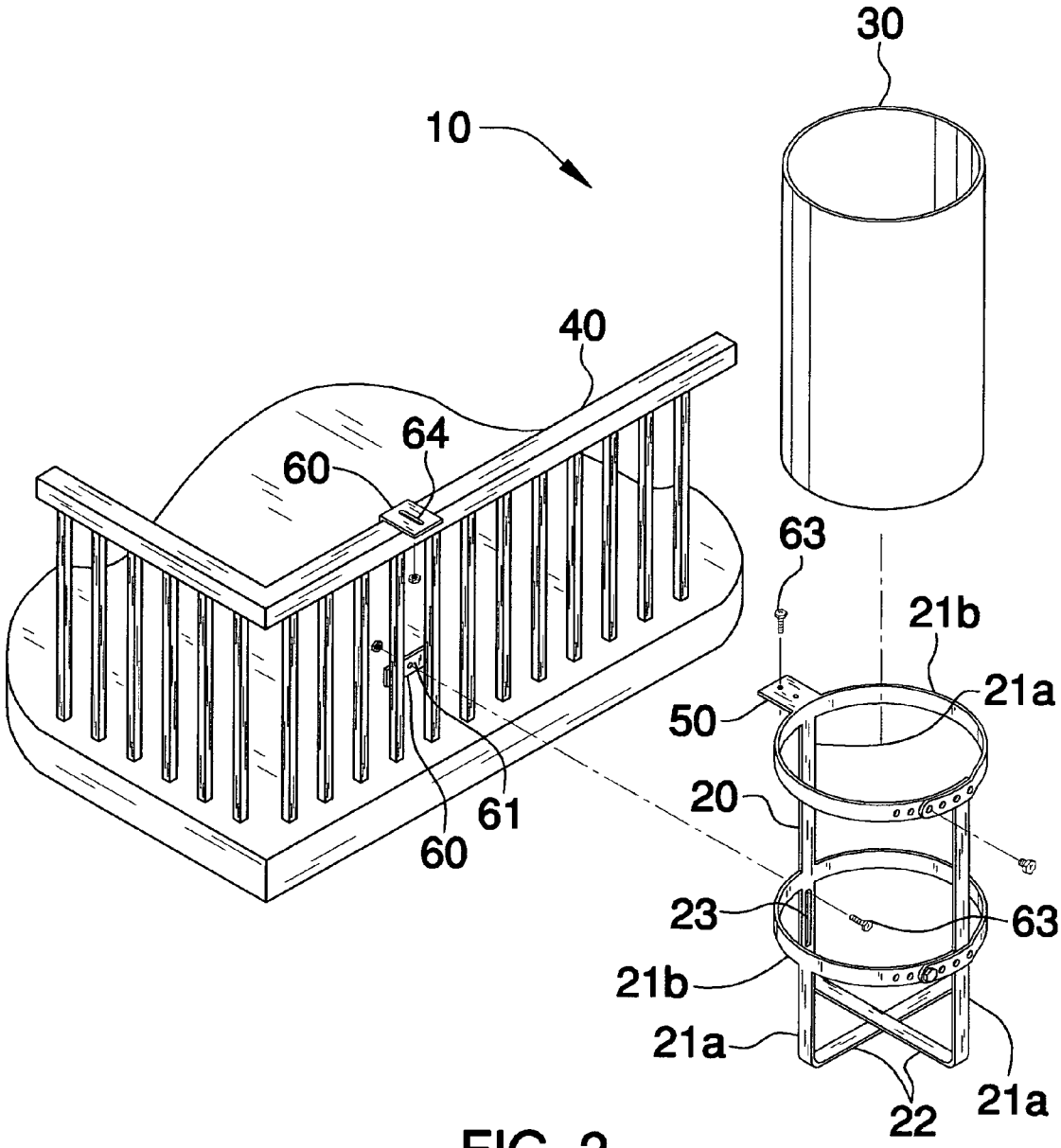
FIG. 2 is an exploded perspective view of the apparatus shown in FIG. 1.
Figure 3:
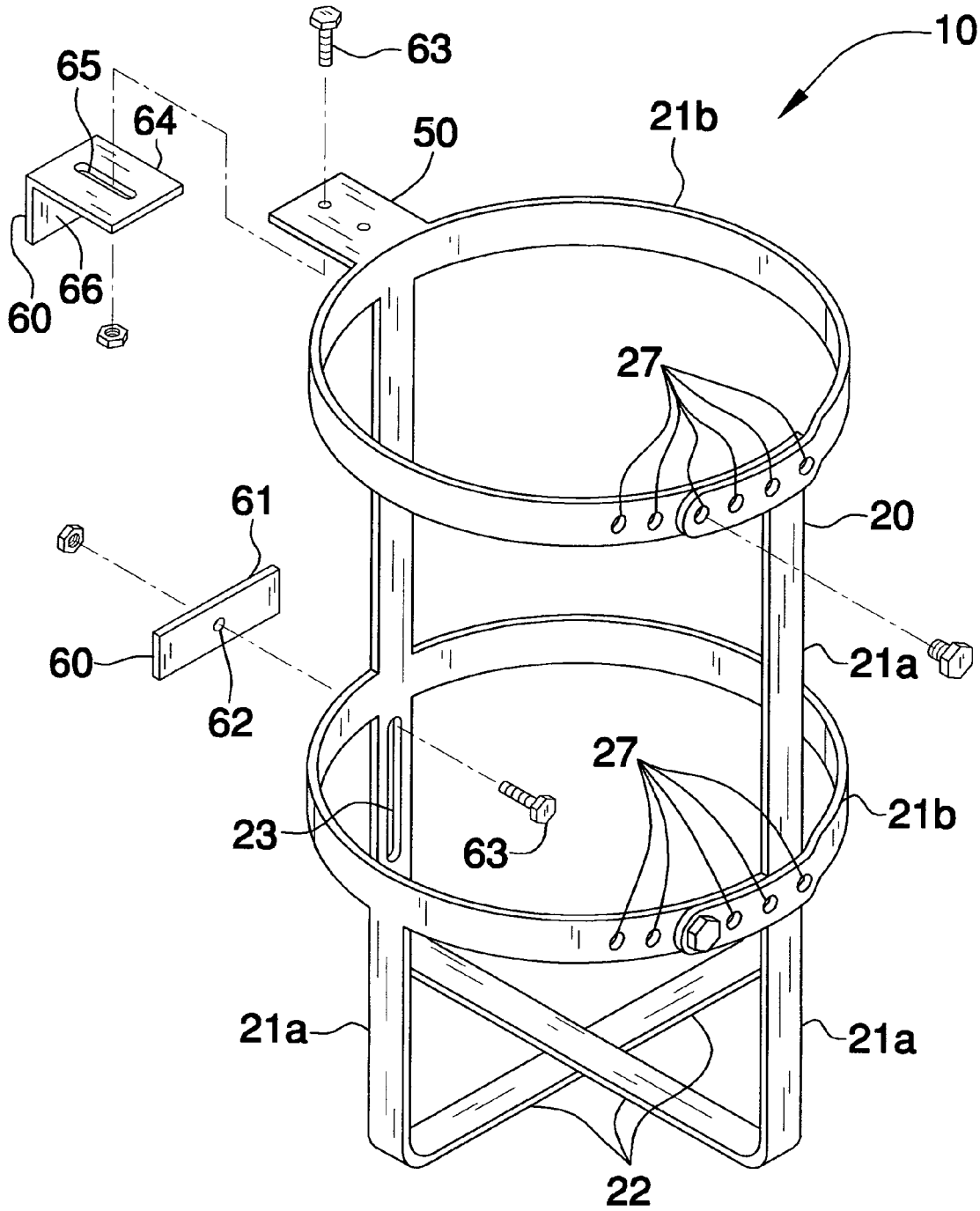
FIG. 3 is an enlarged perspective view of the apparatus shown in FIG. 2.
Figure 4:
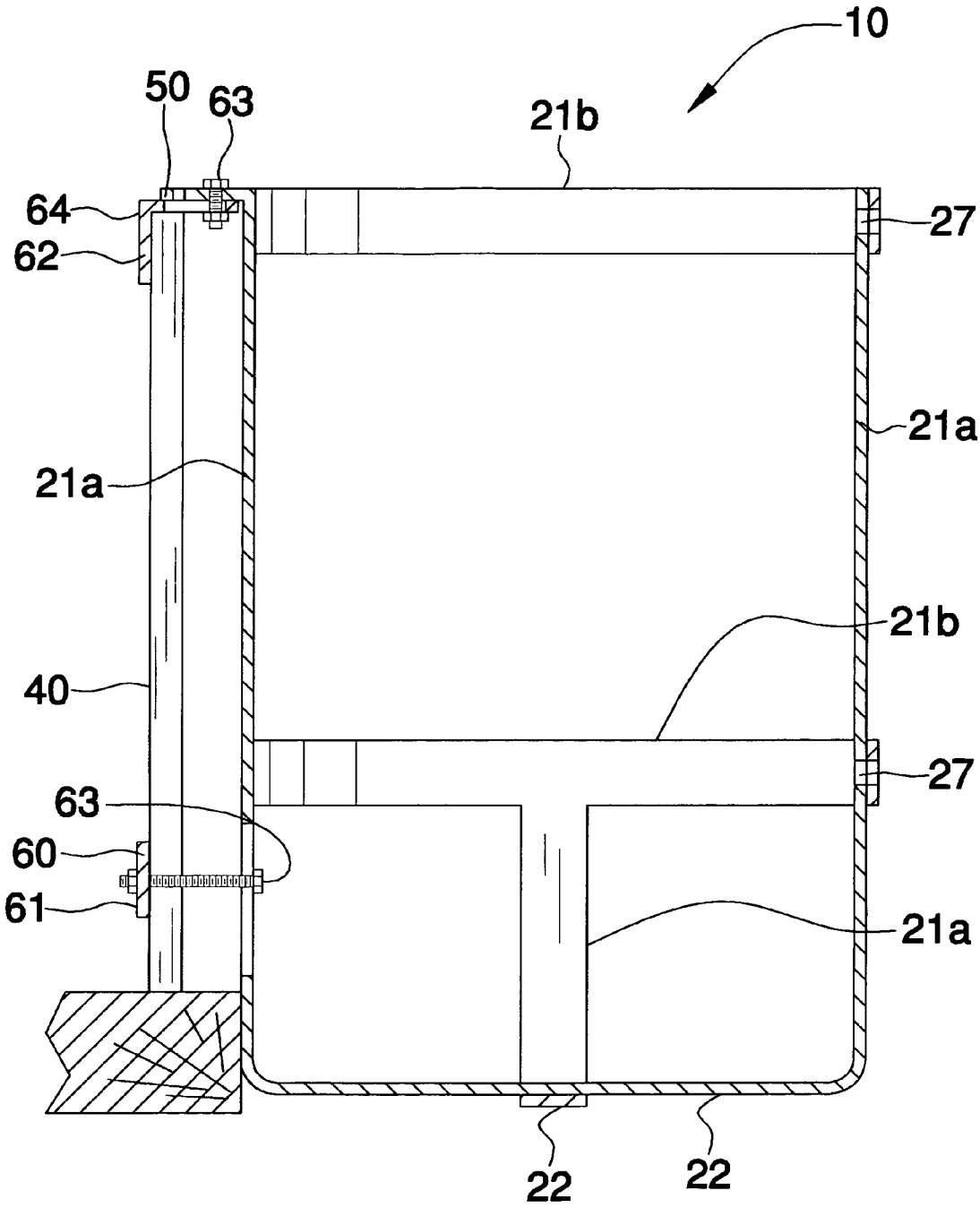
FIG. 4 is an enlarged cross-sectional view of the apparatus shown in FIG. 1, taken along line 4—4.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide an adjustable garbage can holder. It should be understood that the apparatus 10 may be used to hold many different types of containers and should not be limited to only garbage cans.

Referring initially to FIG. 1, the apparatus 10 includes a plurality of integral rails 21 formed from spring steel. Such rails 21 are sized and positioned for defining a substantially cylindrical body 20 that has a centrally disposed longitudinal axis for advantageously receiving a waste basket 30 therein. Select ones 21*a* of the plurality of rails 21 are spaced apart and extend vertically along front and rear portions of the body 20. Such rails 21*a* become disposed substantially parallel to the axis and are provided with traversing lower portions 22. One of such rails 21*a* has a slot 23 formed generally medially therein and is positionable adjacent a support surface 40.

Other ones 21*b* of the plurality of rails 21 have substantially annular shapes spaced along top 24 and bottom 25 portions of the body 20 for defining a diameter thereof. The opposed end portions 26 of such rails 21*b* are provided with a plurality of apertures 27 that are respectively alignable for conveniently adjusting a diameter of the body 20. Advantageously, such rails 20 have opposed end portions 26 removably securable to each other for selectively adjusting the diameter of the body.

The select rails 21*a* further have diametrically opposed upper portions, wherein one of the opposed end portions of the other rails 21*b* are integral with the select rails 21*a* respectively and another opposed end portion of the other rails 21*b* is positionable to the exterior of the select rails 21*a* respectively.

Such a body 20 further includes a flange portion 50 integral with one of the other rails 21*b* and extends rearwardly therefrom. The flange portion 50 is engageable with the support surface 40 and cooperates therewith to maintain the body 20 at a substantially stable position.

The present invention further includes a plurality of spaced brackets 60 for attaching the body 20 to the support surface 40. One 61 of the plurality of brackets 60 has a centrally disposed longitudinal axis extending substantially orthogonal to the axis of the body 20. Such a bracket 61 has a slot 62 extending along the axis thereof and is positionable along an opposite face of the support surface 40 so that a fastening member 63 can be passed from the body 20 rearwardly through the slot 62 for attaching the lower body portion 25 to the support surface 40.

Another one 64 of the brackets 60 has integral top 65 and side 66 portions disposed substantially orthogonal to each other wherein the top portion 65 is slidably engageable with the flange portion 50 for adjustably fastening the upper body portion 24 to the support surface 40.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable garbage can holder that conserves space by being adapted to be mounted to a deck rail, said holder comprising:

a plurality of integral rails sized and positioned for defining a substantially cylindrical body having a centrally disposed longitudinal axis and for receiving a waste basket therein, select ones of said plurality of rails being spaced and extending vertically along front and rear portions of said body wherein said select rails are disposed substantially parallel to the axis, other said plurality of rails have substantially annular shapes spaced along top and bottoms portions of said body for defining a diameter thereof, one said select rails having a slot formed generally medially therein and being adapted to be positioned adjacent a support surface, said other rails having opposed end portions removably securable to each other for selectively adjusting the diameter of said body, said body further including a flange portion integral with one said other rails and extending rearwardly therefrom, said flange portion being adapted to be engaged with the support surface and cooperating therewith to maintain said body at a substantially stable position; and a plurality of spaced brackets for attaching said body to the support surface, one said plurality of brackets having a centrally disposed longitudinal axis extending substantially orthogonal to the axis of said body, said one bracket having a slot extending along the axis thereof and being adapted to be positioned along an opposite face of the support surface so that a fastening member can be passed from said body rearwardly through the slot, said one bracket for attaching said lower body portion to the support surface, another said plurality of brackets having integral top and side portions disposed substantially orthogonal to each other wherein said top portion is slidably engageable with said flange portion for adjustably fastening said upper body portion to the support surface.

2. The holder of claim 1, wherein said plurality of rails are formed from spring steel.

3. The holder of claim 1, wherein opposed end portions of said other rails being provided with a plurality of apertures respectively alignable for adjusting a diameter of said body.

4. The holder of claim 1, wherein said select rails have traversing lower portions.

5. The holder of claim 1, wherein said select rails further have diametrically opposed upper portions.

6. The holder of claim 1, wherein one said opposed end portion of said other rails are integral with said select rails respectively and another said opposed end portion of said other rails is positionable exterior of said select rails respectively.

7. An adjustable garbage can holder that conserves space by being adapted to be mounted to a deck rail, said holder comprising:

a plurality of integral rails sized and positioned for defining a substantially cylindrical body having a centrally disposed longitudinal axis and for receiving a waste basket therein, select ones of said plurality of rails being spaced and extending vertically along front and rear portions of said body wherein said select rails are disposed substantially parallel to the axis, said select rails have traversing lower potions, other said plurality of rails having substantially annular shapes spaced along top and bottoms portions of said body for defining a diameter thereof, one said select rails having a slot formed generally medially therein and being adapted to be positioned adjacent a support surface, said other rails having opposed end portions removably securable to each other for selectively adjusting the diameter of said body, said body further including a flange portion integral with one said other rails and extending rearwardly therefrom, said flange potion being adapted to be engaged with the support surface and cooperating therewith to maintain said body at a substantially stable position; and a plurality of spaced brackets for attaching said body to the support surface, one said plurality of brackets having a centrally disposed longitudinal axis extending substantially orthogonal to the axis of said body, said one bracket having a slot extending along the axis thereof and being adapted to be positioned along an opposite face of the support surface so that a fastening member can be passed from said body rearwardly through the slot, said one bracket for attaching said lower body portion to the support surface, another said plurality of brackets having integral top and side portions disposed substantially orthogonal to each other wherein said top portion is slidably engageable with said flange portion for adjustably fastening said upper body portion to the support surface.

8. The holder of claim 7, wherein said plurality of rails are formed from spring steel.

9. The holder of claim 7, wherein said opposed end portions of said other rails are provided with a plurality of apertures respectively alignable for adjusting a diameter of said body.

10. The holder of claim 7, wherein said select rails further have diametrically opposed upper portions.

11. The holder of claim 7, wherein one said opposed end portion of said other rails are integral with said select rails respectively and another said opposed end portion of said other rails is positionable exterior of said select rails respectively.

12. An adjustable garbage can holder that conserves space by being adapted to be mounted to a deck rail, said holder comprising:

a plurality of integral rails sized and positioned for defining a substantially cylindrical body having a centrally disposed longitudinal axis and for receiving a wasted basket therein, select ones of said plurality of rails being spaced and extending vertically along front and rear portions of said body wherein said select rails are disposed substantially parallel to the axis, said select rails having traversing lower potions, said select rails further having diametrically opposed upper portions, other said plurality of rails having substantially annular shapes spaced along top and bottoms portions of said body for defining a diameter thereof, one said select rails having a slot formed generally medially therein and being adapted to be positioned adjacent a support surface, said other rails having opposed end portions removably securable to each other for selectively adjusting the diameter of said body, said body further including a flange portion integral with one said other rails and extending rearwardly therefrom, said flange portion being adapted to be engaged with the support surface and cooperating therewith to maintain said body at a substantially stable position; and a plurality of spaced brackets for attaching said body to the support surface, one said plurality of brackets having a centrally disposed longitudinal axis extending substantially orthogonal to the axis of said body, said one bracket having a slot extending along the axis thereof and being adapted to be positioned along an opposite face of the support surface so that a fastening member can be passed from said body rearwardly through the slot, said one bracket for attaching said lower body portion to the support surface, another said plurality of brackets having integral top and side portions disposed substantially orthogonal to each other wherein said top portion is slidably engageable with said flange portion for adjustably fastening said upper body portion to the support surface.

13. The holder of claim 12, wherein said plurality of rails are formed from spring steel.

14. The holder of claim 12, wherein said opposed end portions of said other rails are provided with a plurality of apertures respectively alignable for adjusting a diameter of said body.

15. The holder of claim 12, wherein one said opposed end portion of said other rails are integral with said select rails respectively and another said opposed end portion of said other rails is positionable exterior of said select rails respectively.

* * * * *